United States Patent [19]

Ciliberto et al.

[11] Patent Number: 4,915,086

[45] Date of Patent: Apr. 10, 1990

[54] VARIABLE-ENERGY-SPARK IGNITION SYSTEM FOR INTERNAL COMBUSTION ENGINES, PARTICULARLY FOR MOTOR VEHICLES

[75] Inventors: Giuseppe Ciliberto; Guido Scollo, both of Turin, Italy

[73] Assignee: Marelli Autronica S.p.A., Milan, Italy

[21] Appl. No.: 163,333

[22] Filed: Mar. 2, 1988

[30] Foreign Application Priority Data

Mar. 2, 1987 [IT] Italy ..... 67153 A/87

[51] Int. Cl.[4] ..... F02P 3/05

[52] U.S. Cl. ..... 123/609; 123/625; 123/644

[58] Field of Search ..... 123/644, 625, 609

[56] References Cited

U.S. PATENT DOCUMENTS

| | | | |
|---|---|---|---|
| 4,378,778 | 4/1983 | Harter | 123/644 |
| 4,558,684 | 12/1985 | Caddy et al. | 123/644 |
| 4,750,467 | 6/1988 | Neuhalfen | 123/644 |

FOREIGN PATENT DOCUMENTS

| | | | |
|---|---|---|---|
| 0022259 | 1/1981 | European Pat. Off. | 123/644 |
| 3447341 | 6/1986 | Fed. Rep. of Germany | 123/644 |
| 57-200669 | 12/1982 | Japan | 123/644 |
| 59-128975 | 7/1984 | Japan | 123/609 |

*Primary Examiner*—Andrew M. Dolinar

*Attorney, Agent, or Firm*—Sughrue, Mion, Zinn, Macpeak & Seas

[57] ABSTRACT

An ignition system for at least one spark plug of an internal combustion engine includes an ignition coil having a secondary winding connected to the plug, a control commutator device controlling the flow of current in the primary winding of the ignition coil, a device for monitoring the intensity of the current flowing in the primary winding and electrical sensors which provide signals indicative of the operating conditions of the engine. A control unit is provided with memory devices in which are stored data indicative of predetermined final values for the current in the primary winding of the ignition coil associated with various operating conditions of the engine. The control unit is also arranged to pilot the commutator device so that each time a spark needs to be generated the flow of current in the primary winding of the ignition coil is stopped when the magnitude of current has reached the final value which is associated in the memory device with the prevailing operating conditions of the engine.

6 Claims, 2 Drawing Sheets

Figure 1:
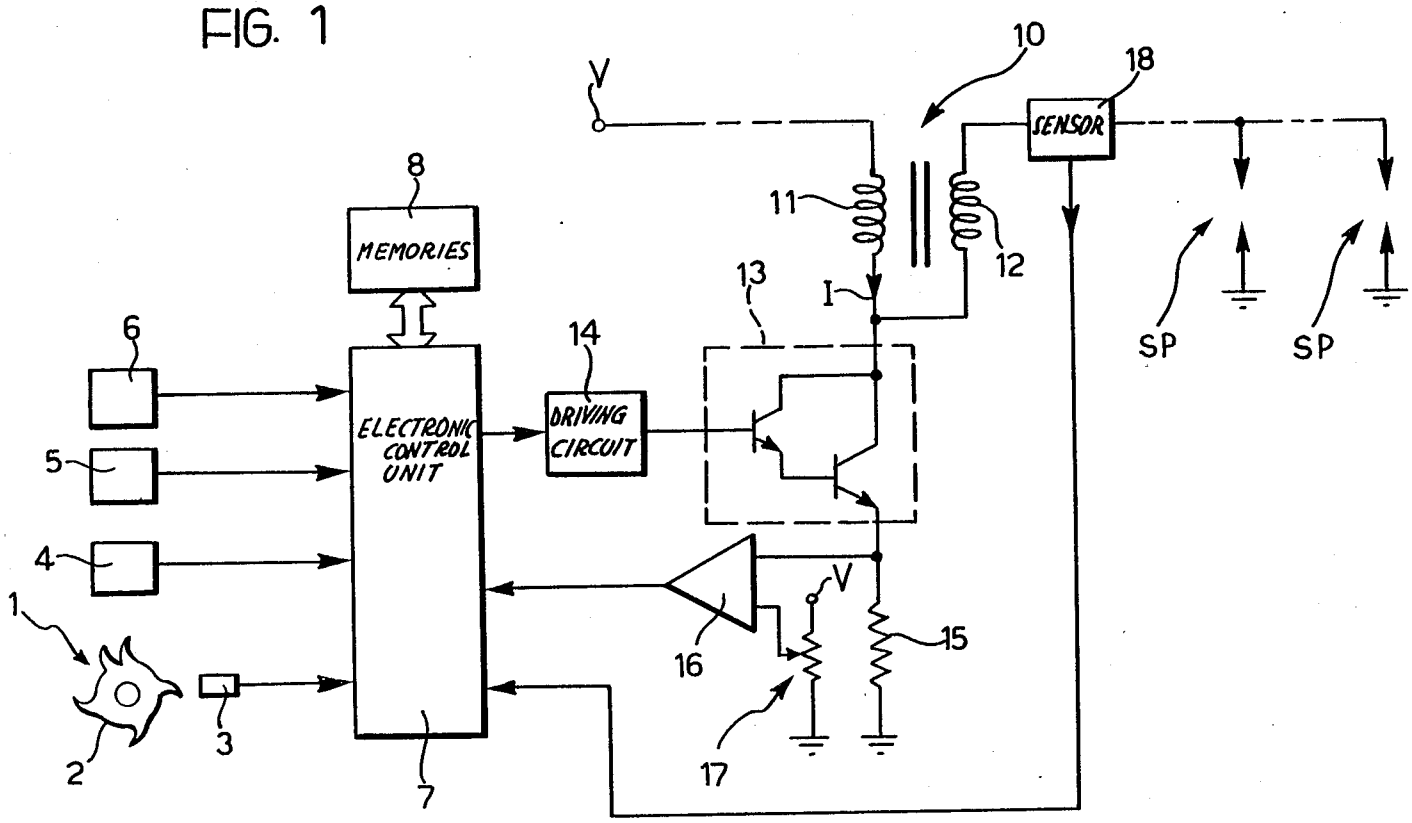

VARIABLE-ENERGY-SPARK IGNITION SYSTEM FOR INTERNAL COMBUSTION ENGINES, PARTICULARLY FOR MOTOR VEHICLES

DESCRIPTION

The present invention relates to an internal combustion engine ignition system and, in particular, to a system of the type including at least one spark plug, at least one ignition coil whose primary winding is connectible to the at least one plug to generate a spark, commutator means adapted to assume first and second conditions which respectively permit and interrupt the flow of current in the primary winding of the ignition coil, means for monitoring the intensity of the current flowing in the primary winding of the ignition coil, electrical sensor means for sensing the operating conditions of the engine, and an electronic control unit arranged to pilot the commutator means in a predetermined manner according to the signals provided by the sensor means and by the monitoring means.

Electronic ignition systems of this type produced up till now tend to effect ignition with a constant discharge or spark energy. These systems are therefore arranged so that the same energy is almost always supplied to the spark plugs. The energy level is necessarily high in order for a spark to be produced under all anticipated operating conditions of the engine. In many situations, therefore, this energy level is somewhat higher than that strictly required to ensure ignition. This obviously results in a waste of energy and in increased stresses on the components of the ignition system, and particularly on the ignition coil (or coils), the plugs and the commutator devices which, in a very large majority of known systems, include a pair of transistors connected in a Darlington arrangement.

The object of the present invention is to produce an ignition system of the type specified which limits the above inconveniencies of the prior art systems.

This object is achieved according to the invention by means of an ignition system of the type specified above, whose principal characteristic lies in the fact that the electronic control unit includes memory means in which there are stored data indicative of predetermined final values of the current in the primary winding of the at least one ignition coil, associated with different operating conditions of the engine identifiable from the signals from the sensor means; the electronic control unit is also able to pilot the commutator means so that each time a spark needs to be generated, the current flow in the primary winding of the ignition coil is interrupted when its intensity has reached the value associated in the memory means with the operating conditions of the engine indicated by the sensor means.

The system according to the invention thus enables ignition to be achieved with a spark whose energy is "modulated", that is, varied in accordance with the values assumed by the quantities monitored by the sensors associated with the engine.

The system according to the invention thus reduces the energy dissipated by the controlled commutator device and the average temperature of the ignition coil. Moreover, with the ignition system according to the invention, the plugs presumably have a longer life.

Figure 2:
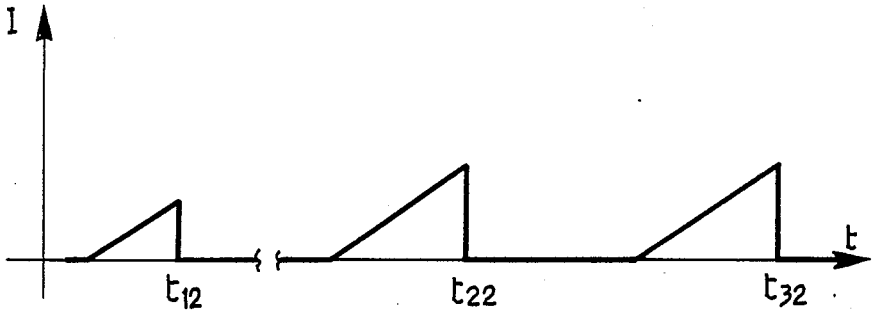
Figure 3:
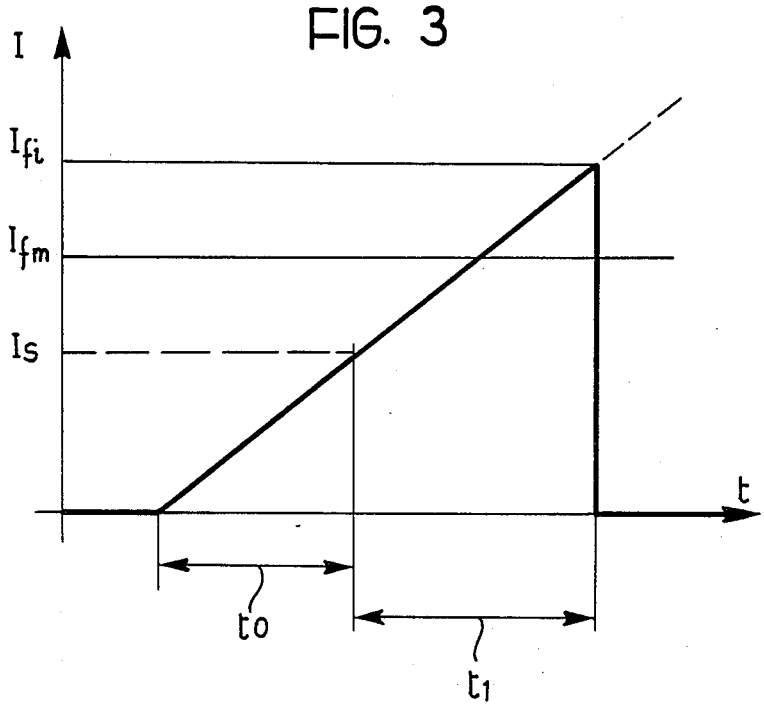

Further characteristics and advantages of the ignition system according to the invention will be seen from the detailed description which follows, with reference to the appended drawings provided purely by way of non-limiting example, in which:

FIG. 1 is an electrical diagram, partly in block form, of an ignition system according to the invention, FIG. 2 is a graph showing possible current levels I in the primary winding of the ignition coil of the system of FIG. 1 as a function of the time t, and FIG. 3 is an explanatory diagram showing, on an enlarged scale, possible levels of the current I as a function of the time t, useful for understanding the way in which the system according to the invention controls the final value reached by the current in the primary winding of the ignition coil.

With reference to FIG. 1, a sensor of the type known as a phonic wheel is generally indicated 1 and comprises a toothed rotor 2 rotated directly or indirectly by the shaft of an internal combustion engine in known manner, not shown. This rotor is inductively coupled to a receiver (pick-up) 3 which, in known manner, outputs a signal whose frequency is indicative of the rate of rotation of the shaft of the internal combustion engine. Moreover, again in known manner, from the signals it is possible to derive information on the angular position of the shaft of the motor and to determine the amount at which a spark should be produced in the various cylinders from the signals output by the pick-up 3.

Reference numeral 4 indicates an electrical sensor for sensing the vacuum in the inlet manifold of the engine. Reference numeral 5 indicates a sensor for sensing the temperature of the air intake to the engine, whilst numeral 6 indicates a possible further sensor for sensing the temperature of the engine coolant. The pick-up 3 and the sensors 4 to 6 are connected to an electronic microprocessor control unit 7 of known type, having associated memories generally indicated 8.

An ignition coil generally indicated 10 has a primary winding 11 connected to a voltage source V (for example the battery of the motor vehicle) and a secondary winding 12 selectively connectible to the plugs SP of the engine, for example through a rotary distributor of known type.

The primary winding 11 of the coil 10 is connected to a commutator device generally indicated 13 which in the embodiment shown, includes a pair of Darlington connected transistors which are controlled by the microprocessor unit 7 through a driving circuit 14 of a per se known type.

A resistor 15 is connected to the emitter of the output transistor of the commutator device 13 so that, in operation, substantially the same current flows in this as in the primary winding 11 of the ignition coil 10. The nonearthed terminal of the feedback resistor 15 is connected to an input of a threshold comparator 16 which compares the fall in voltage across the resistor 15 with a reference voltage generated, for example, by a potentiometer 17. In operation, the comparator 16 supplies a signal to the microprocessor unit 7 when the voltage across the resistor 15 indicates that the current in the primary winding 11 of the ignition coil 10 has reached a predetermined threshold value.

In operation, when the Darlington transistor 13 is saturated, a current begins to flow in the primary winding 11 of the ignition coil. This current, whose initial trace is almost linear, increases substantially exponentially.

When the Darlington transistor is cut off, the current in the primary winding 11 is interrupted and the corresponding high voltage generated in the secondary winding triggers the parks in the plug or plugs SP connected to the ignition coil 10 at that moment.

In the memory devices 8 of the microprocessor unit 7 there are stored data indicative of predetermined final values of the current in the primary winding of the coil 10, associated with various values or ranges of values assumed by the parameters or quantities monitored by the sensors 4 to 6. In practice, graphs which correlate the optimal final value of the current in the primary winding of the ignition coil 10 with the values assumed by the quantities monitored by the sensors 3 to 6 are stored in the memories 8 in digital form.

The control unit 7 is programmed by conventional techniques to saturate and to cut off the Darlington transistor 13 at time deduced by analysis of the signal provided by the pick-up 3. As stated above, when the Darlington transistor 13 is saturated, the current in the primary winding of the ignition coil starts to increase in an approximately linear manner, as indicated, for example, by the wave form shown in FIG. 2. The time constant, or rate at which the current in the primary winding increases, is linked to the resistance and the inductance of the primary winding and to the resistance of the resistor 15.

Moreover, the resistance of the primary winding can vary with changes in temperature. The strength of the current at any particular time can also be influenced by variation in the voltage V.

The control unit 7 is arranged to control the time during which the Darlington transistor 13 remains conductive so that the current in the primary winding 11 of the ignition coil reaches the final value which is associated, in the memories 8, with the values of the quantities registered by the sensors 3 to 6 at that moment. In this way, the system according to the invention achieves ignition with a spark energy which is variable, and hence optimised, according to the varying operating conditions of the engine. As stated above, this reduces the average temperature of th ignition coil and the energy dissipated by the Darlington transistor 13.

The microprocessor unit 7 can conveniently be arranged to control the reaching of the required final value of the current in the primary winding of the ignition coil in the following manner.

The threshold comparator 16 sends a signal to the control unit 7 when the current I in the winding 11 of the ignition coil reaches a threshold value $I_s$ (FIG. 3) which is less than the prescribed final minimum value $I_{fm}$ (FIG. 3). This happens, for example, after a period of time $t_0$ (FIG. 3) from the moment at which current starts to flow.

The microprocessor unit 7 has an internal clock and is programmed to evaluate the duration of the interval $t_0$. On the basis of this information, and by means of a simple predictive algorithm, the control unit 7 can, by interpolation, deduce the duration of the further period of time $t_1$ (FIG. 3) necessary for the current I to reach the final value $I_{fi}$ which is associated, in the memories 8, with the values of the quantities monitored by the sensors 3 to 6 at the time.

It can be seen immediately that this procedure for determining the total time for which current flows in the ignition coil is not influenced by variations in the current I due to variations in the resistance of the winding 11 and/or variations in the voltage V.

The system according to the invention can also conveniently include electrical monitoring means adapted to provide signals indicative of the "quality" of the sparks triggered by the plugs SP. Such monitoring means could, for example, consist of a sensor 18 (FIG. 1) connected to the output of the ignition coil 10 and adapted to provide a signal indicative of (for example, proportional to) the peak value of the high voltage applied to the plugs to trigger the spark. The sensor 18, which could, for example, be a potential divider, is connected to the control unit 7. This can further conveniently be programmed to receive the signal output by the sensor 18 and compare it with predetermined reference levels. On the basis of this comparison, the unit 7 can according to the program stored in its memory, enable the transistor 13 to be conductive until the current in the winding 11 reaches a value corresponding to the value which is associated in the memories 8 with the prevailing operating conditions of the engine, which value is, however, reduced or increased by a correction factor which varies according to the signal provided by the sensor 8. This type of feedback control of the current in the winding 11 has advantages in that the energy of the spark can be optimised, not only in dependence on the prevailing operating conditions of the engine, but also on the prevailing conditions of the ignition system.

We claim:

1. An ignition system for an internal combustion engine, comprising:

at least one spark plug;

at least one ignition coil whose secondary winding is connectible to the at least one spark plug to induce the generation of a spark;

commutator means adapted to assume first and second conditions which respectively permit and interrupt the flow of a current in the primary winding of the ignition coil;

electrical sensor means for providing electrical signals indicative of operating conditions of the engine, and control means coupled to the commutator means and the electrical sensor means and adapted to pilot the commutator means so as to vary, in accordance with the signals provided by said sensor means, the energy applied to said at least one spark plug for the generation of the sparks;

wherein the control means include monitoring means for monitoring the current flowing in the primary winding of the ignition coil, and an electronic control unit arranged to pilot the commutator means in a predetermined manner in accordance with the signals provided by the sensor means and by the monitoring means;

the said electronic control unit being provided with memory means in which there are stored data indicative of predetermined final values of the current in the primary winding of the ignition coil, associated with various operating conditions of the engine identifiable from the signals from the sensor means, the electronic control unit being further arranged to pilot the commutator means so that, each time a spark needs to be generated, the current flow in the primary winding of the ignition coil is interrupted when its intensity has reached a value associated in the memory means with the operating conditions of the engine indicated by the sensors; and wherein the monitoring means are arranged to supply the electronic control unit with a signal when the intensity of the current in the primary winding of the ignition coil reaches a threshold value less than the minimum final value stored in the memory means, and in that this unit is arranged to monitor the time taken by the current to reach the threshold value, to calculate the further period of time necessary for the current to reach the final value associated with the operating conditions of the engine registered by the sensor means and stored in the memory means, and to maintain the commutator means in the first condition for the further period of time.

2. An ignition system according to claim 1, wherein the sensor means include a sensor for sensing the vacuum in the inlet manifold of the engine.

3. An ignition system according to claim 2, wherein the sensor means include means for monitoring the temperature of the engine.

4. An ignition system for an internal combustion engine, comprising:

at least one spark plug;

at least one ignition coil whose secondary winding is connectible to the at least one spark plug to induce the generation of a spark;

commutator means adapted to assume first and second conditions which respectively permit and interrupt the flow of a current in the primary winding of the ignition coil;

electrical sensor means for providing electrical signals indicative of operating conditions of the engine, and control means coupled to the commutator means and the electrical sensor means and adapted to pilot the commutator means so as to vary, in accordance with the signals provided by said sensor means, the energy applied to said at least one spark plug for the generation of the sparks;

wherein the control means include monitoring means for monitoring the current flowing in the primary winding of the ignition coil, and an electronic control unit arranged to pilot the commutator means in a predetermined manner in accordance with the signals provided by the sensor means and by the monitoring means;

the said electronic control unit being provided with memory means in which there are stored data indicative of predetermined final values of the current in the primary winding of the ignition coil, associated with various operating conditions of the engine identifiable from the signals from the sensor means, the electronic control unit being further arranged to pilot the commutator means so that, each time a spark needs to be generated, the current flow in the primary winding of the ignition coil is interrupted when its intensity has reached a value associated in the memory means with the operating conditions of the engine indicated by the sensors; and further monitoring means arranged to provide electrical signals indicative of the quality of the spark triggered by the at least one plug, and in that the electronic control unit is also arranged to pilot the commutator means so that for the generation of a spark the current in the primary winding of the ignition coil is interrupted when its intensity has reached a value corresponding to the value associated in the memory means with the prevailing operating conditions of the engine, which value is reduced or increased by a correction factor which varies according to the signal supplied by the further monitoring means.

5. An ignition system according to claim 4, wherein the sensor means include a sensor for sensing the vacuum in the inlet manifold of the engine.

6. An ignition system according to claim 5, wherein the sensor means include means for monitoring the temperature of the engine.

* * * * *